United States Patent [19]

Jones

[11] 4,026,441

[45] May 31, 1977

[54] ROOF-GRAVEL REMOVAL APPARATUS

[76] Inventor: Richard C. Jones, 6950 Weiman Court, Commerce City, Colo. 80022

[22] Filed: Apr. 5, 1976

[21] Appl. No.: 673,981

[52] U.S. Cl. ..... 222/609; 214/17 R; 214/501

[51] Int. Cl.[2] ..... B60P 3/00; B65G 65/52

[58] Field of Search ..... 214/17 R, 2, 501; 52/69, 117, 119; 222/178, 185, 160

[56] References Cited

UNITED STATES PATENTS 3,985,254 10/1976 Grandury ..... 214/515

*Primary Examiner*—Albert J. Makay

*Attorney, Agent, or Firm*—Edwin L. Spangler, Jr.

[57] ABSTRACT

This invention relates to a roof-gravel removal apparatus including a trailer-mounted foldable frame which cooperates with the trailer on which it is mounted to define a drive-through archway when fully unfolded, said archway supporting a hopper or the like in position to deposit the contents thereof into the bed of a truck waiting therebeneath. Vertically adjustable stanchions disposed at the rear end of the trailer behind its wheels cooperate with the front section of the frame to produce the front legs of the arch when the latter is fully unfolded. The vacuuming apparatus and associated equipment are located on the trailer bed so as to cooperate therewith and counterbalance the foldable frame and hopper subassembly supported thereon. The mid-section of the frame carrying the hopper is hingedly connected to the front section in offset relation such that a gap is left therebetween in folded position sized to receive and house the rear section. The invention also includes the sequence of folding and unfolding the frame which comprises first elevating the entire frame into an upwardly and forwardly inclined position relative to the trailer bed, raising the mid and rear sections as a unit while still folded into right angular relation relative to the front section, unfolding the rear section and lowering the frame thus unfolded down onto the ground.

9 Claims, 7 Drawing Figures

ROOF-GRAVEL REMOVAL APPARATUS

Tar and gravel roofs require periodic resurfacing in order to have them maintain their waterproof integrity and, as a preliminary adjunct to this resurfacing operation, the old loose gravel must be removed. To accomplish this, multistage vacuum type separators are often used which suck up loose gravel along with the dirt, dust and other particulate matter and classify it according to weight by an initial gravity separation folowed by a centrifugal separation and then finally a mechanical one. What for lack of a better term can be referred to as the "middlings" and "fines" generally cause no problem as substantial quantities thereof can be collected and stored in a relatively small portable receptacle. The coarse material consisting mostly of gravel, on the other hand, creates a monumental disposal problem on all but the smallest jobs.

This gravel is separated out into a compartmentalized hopper of a special design which forms no part of the present invention but which is used to collect the gravel and other large and middle sized particles until they can be hauled away and disposed of. Such receptacles are, of necessity, quite large and most difficult to erect temporarily at the job site for use until the roof is prepared for resurfacing only to be taken down again and transferred to another location. The ideal solution to the problem would, of course, be a portable apparatus of some type which could be hauled from one location to another without having to be disassembled and reassembled each time. While attempts have been made at producing such a portable apparatus, they have been impractical and, for this reason, have enjoyed little commercial success.

It has now been found in accordance with the teaching of the instant invention that a truly portable trailer mounted gravel-receiving hopper mounted atop a foldable arch-like frame can, in fact, be made which answers the needs of the roofing industry and which functions as a convenient carrier for other components of the system like the vacuum pump, dust collector, hoses, and the like. The trailer itself cooperates with the front section of the foldable frame to define one side of the arch. The rear section of the frame constitutes the other side of the arch and folds into a gap left between the front section and the midsection that carries the hopper subassembly atop thereof. Hydraulic servomotors operatively connected to each of the three sections independently control their movements. This feature is significant in that proper sequential actuation of the several frame sections is important both from the standpoints of getting them to fold and unfold properly and, in addition, to maintain a condition of stability with the heavy hopper aboard while these operations are taking place. For this reason, the instant invention also encompasses the novel method of folding and unfolding the frame.

It is, therefore, the principal object of the present invention to provide a novel and improved roof-gravel removal apparatus that includes a foldable frame for supporting a hopper or similar receptacle in position whereby a truck or other vehicle can drive into position therebeneath.

A second objective of the invention herein disclosed and claimed is to provide a novel method of folding and unfolding the hopper-carrying frame.

Another object is to provide an apparatus of the type forming the subject matter hereof in which the trailer and other equipment mounted thereon cooperate with one another so as to produce a counterbalance effective to maintain the assembly in stable condition while the frame is being folded and unfolded.

Still another objective is the provision of a three section foldable frame in which each section is independently movable relative to the other two sections and to the trailer upon which said frame is hingedly mounted.

An additional object is to provide a self-contained apparatus for removing loose gravel from tar and gravel roofs to be resurfaced which can be set up ready for use in a matter of a few minutes by unskilled persons.

Further objects are to provide apparatus of the type aforementioned which is simple yet sturdy, rugged, relatively lightweight, readily adjustable to accommodate uneven ground, versatile, compact and easy to operate and service while at the same time being somewhat decorative.

Other objects will be in part apparent and in part pointed out specifically hereinafter in connection with the description of the drawings that follows, and in which.

Figure 1:
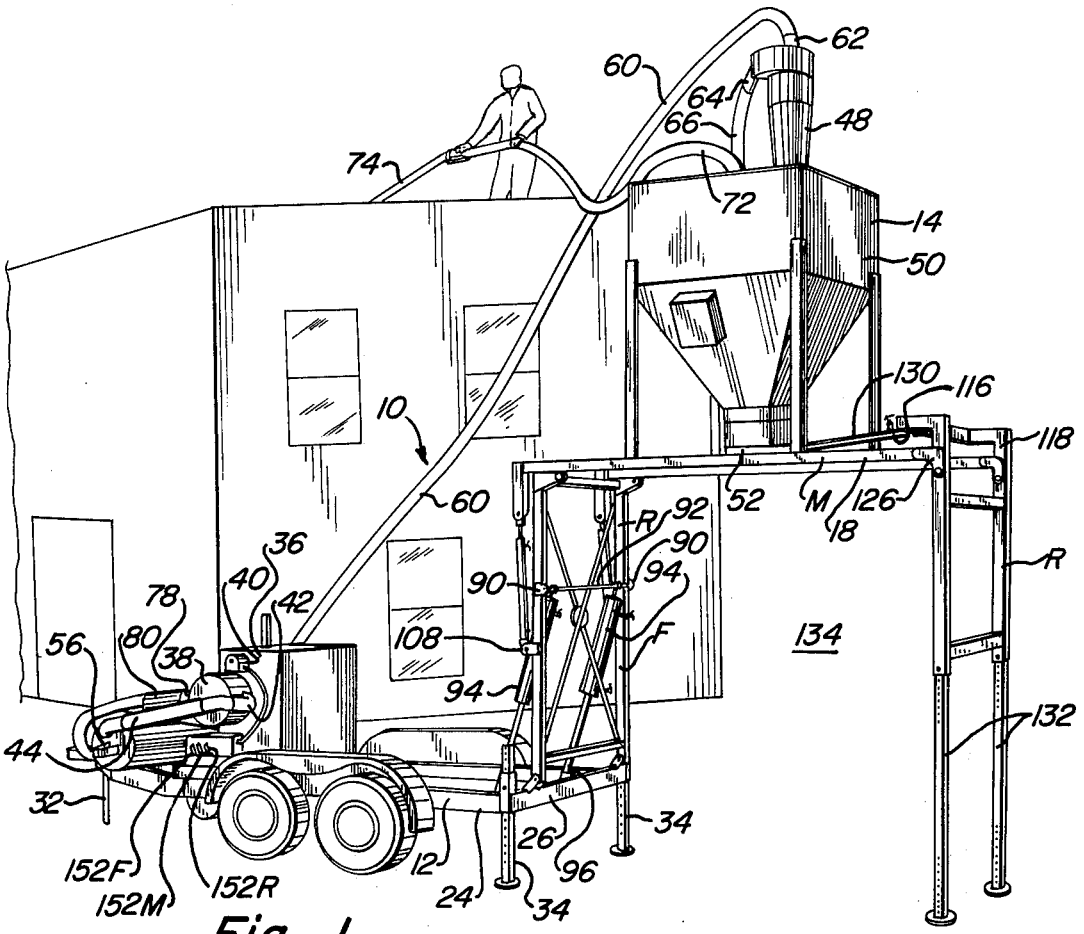
FIG. 1 is a perspective view showing the roof-gravel removal apparatus fully erected and in operation to vacuum gravel and other loose particulate matter off the tar and gravel roof of a two story building.
Figure 2:
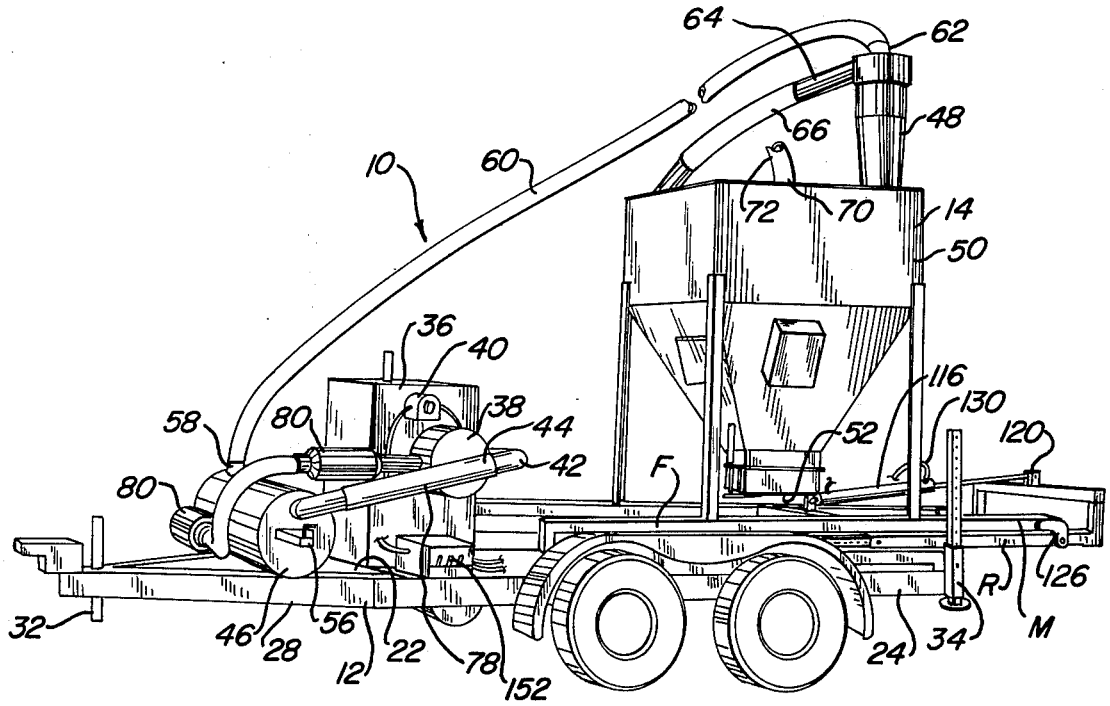
FIG. 2 is a perspective view to a slightly larger scale than FIG. 1 showing the apparatus in stowed condition ready to be towed to another location.

Referring next to the drawings for a detailed description of the present invention and, initially, to FIGS. 1 and 2 for this purpose, reference numeral 10 has been selected to designate the mobile gravel removal apparatus broadly while numeral 12 refers to the trailer that carries the hopper subassembly 14, the vacuum-generating equipment 16 and, most significant of all, the foldable frame 18 together with the various hydraulic servomotors used to actuate the latter, all of which have been designated in a general way by numeral 20. The trailer has a flat bed 22 made up of steel sideframe members 24, crossframe members 26 and a forwardly-projecting tongue formed by convergent frame elements 28. The wheels 30 in the particular form shown are journalled for rotation about transverse axes located one behind the other approximately midway between the ends. Adjustable jacks 32 and 34 located at the front and rear ends, respectively, stabilize the bed while in use in the manner illustrated in FIG. 1. These jacks are, of course, stowed in the retracted position of FIG. 2 when the apparatus is being moved from one location to another.

Figure 6:
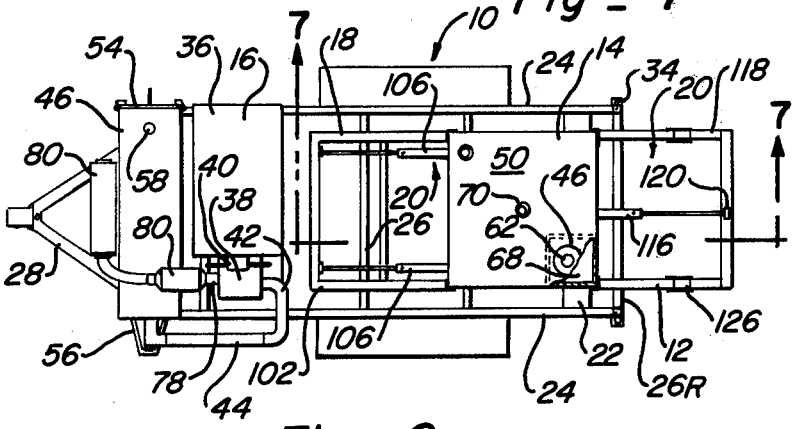
FIG. 6 is a top plan view of the apparatus.

Mounted on the front end of the trailer bed 22 forwardly of the wheels 30 for counterbalancing purposes is the vacuum-generating equipment which includes a large internal combustion engine 36 that operates both the vacuum pump 38 and the hydraulic pump 40. Air is drawn into the suction side 42 of the vacuum pump through large diameter conduit 44 connected into one end of a filter tank 46. Into this tank is drawn most of the finely divided particulate matter that escapes the cyclone separator 48 atop the hopper 50, both of which together with the hydraulically-actuated gate 52 on the bottom of the latter and the various air hoses and hydraulic lines make up the hopper subassembly 14. A door 54 (FIG. 6) on the other end of the filter tank provides access to the latter for emptying same. This door is, of course, tightly sealed against the end of the tank in order to maintain the desired vacuum. Also, a hydraulically actuated valve 56 on the end of the tank where conduit 44 enters is operative up actuation to close off the latter and thus effectively shut down the entire vacuum system even though the pump 38 is left running. By so doing, the filter tank can be emptied without having to stop the engine or shut down the hydraulic system.

The inlet 58 into the filter tank connects onto vacuum hose 60, the other end of which connects into the centrally located outlet or vortex of cyclone 48 as indicated at 62. The tangential outlet 64 of the cyclone, on the other hand, is connected by hose 66 into compartment 68 (FIGS. 6 and 7) inside hopper 50. This compartment 68 collects the middleweight particulate matter separated from the fine particulate matter by the centrifugal action of the cyclone.

The main inlet 70 into the hopper receives vacuum hose 72, the opposite end of which is equipped with a suitable nozzle 74 that is used to vacuum up the loose gravel and other particulate matter off a building roof that is to be resurfaced. The gravel and lighter particulate matter initially enters the main compartment 76 (FIG: 7) of the hopper where the heaviest particles gravitate out and are ultimately removed through the trap door 52 in the bottom thereof. Those middleweight and fine particles that can be sucked up into the cyclone are further classified by the latter such that the middleweight particles are separated centrifugally and deposited in compartment 68 alongside the main compartment 76 in the hopper. The "fines" are then sucked into the filter tank where they are filtered out in the usual manner and deposited therein.

The exhaust air leaving the system passes out of the pump 38 at outlet 78 and then through a pair of serially-connected dust filters 80 which remove the last vestiges of the fine particulate matter that passes through the filter tank. The resulting three stage separator has a first gravity stage for separating out the heavier particulate matter in the hopper, a second centrifugal stage utilizing a cyclone separator to collect the middleweight fraction, and a third screening stage for capturing the fines. The bulk of all the particulate material collected will consist of gravel which gravitates out in the first stage. The major problem, therefore, becomes one of emptying the hopper at frequent intervals.

To vacilitate this emptying operation, the foldable frame 18 cooperates in unfolded position to define a drive-through archway with the hopper supported atop thereof as shown in FIG. 1. This frame 18 comprises three hingedly interconnected sections, the front section F being hinged to the rear end of the trailer bed for movement between a folded position lying atop thereof and an unfolded position extending upwardly in substantially vertical relation. A pair of ears 82 project upwardly from the rear crossframe member 26R of the trailer bed where they pivotally connect onto the rear end of the front frame section F so as to permit the latter to lay down flush atop the trailer bed.

Figure 7:
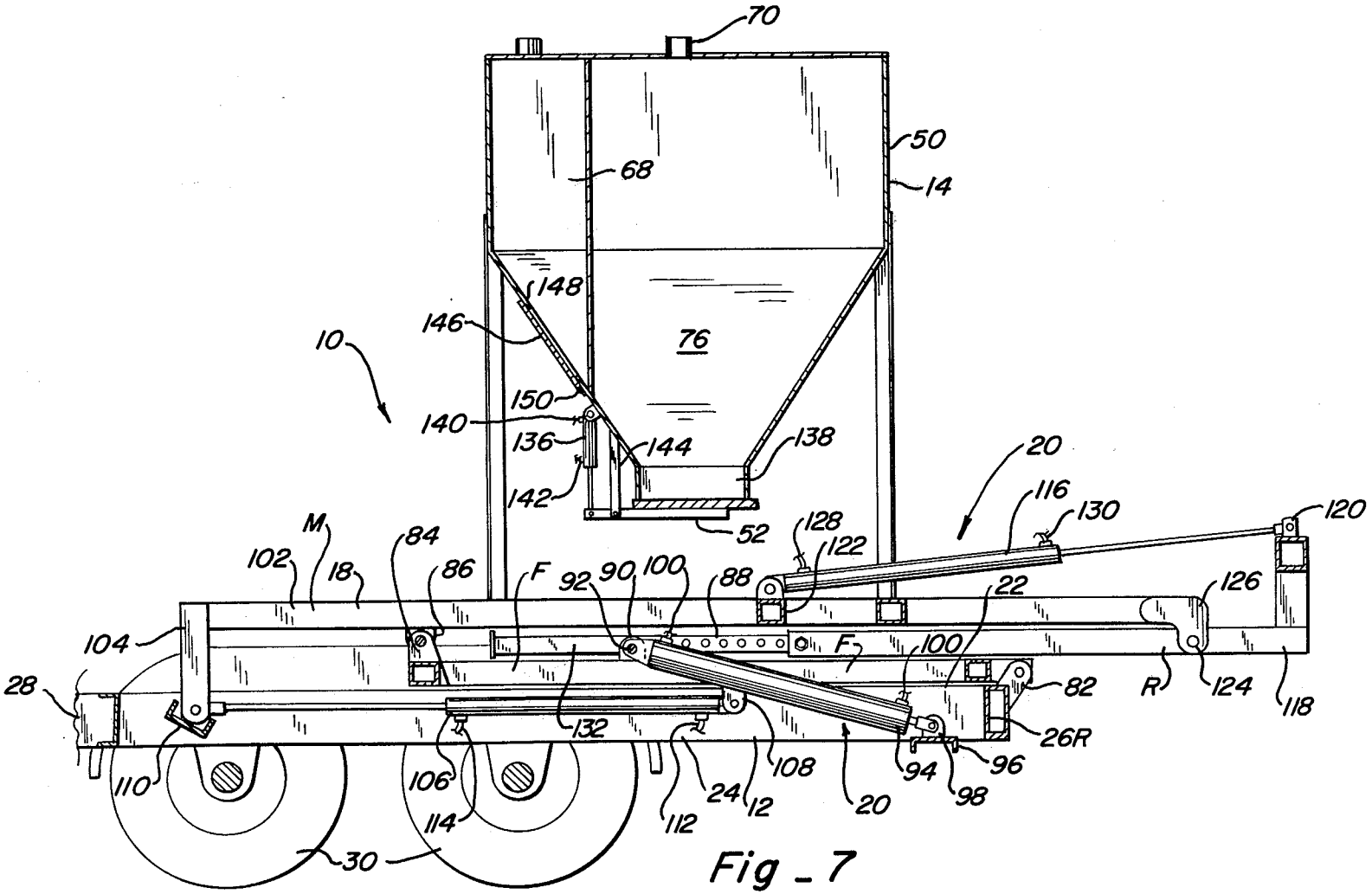
FIG. 7 is a section taken along line 7—7 of FIG. 6 to an enlarged scale.

In folded position, the front end of the front frame section carries a pair of upstanding ears 84 which pivotally connect onto similar downwardly-projecting ears 86 spaced rearwardly from the front end of the midsection M of the frame so as to cooperate therewith and leave a gap 88 between the front and midframe sections when folded that is sized to receive the rear frame section R as shown in FIG. 7.

Figure 3:
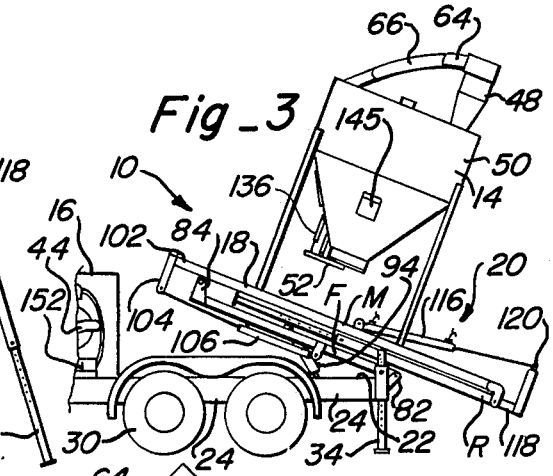
FIG. 3 is a side elevation to a reduced scale showing the initial stage in the erection of the hopper in which the foldable frame while still folded is lifted into an inclined position relative to the bed of the trailer.

Next, with specific reference to FIG. 7, it will be seen that a pair of shaft connectors 90 are located between the front and rear ends of front frame section F that fasten a shaft 92 in horizontal position extending transversely therebetween. The front ends of a pair of conventional hydraulic servomotors connect onto shat 92 within gap 88 left between the front and midsections F and M of the frame when folded. A crossframe member 96 on the underside of the trailer bed 12 near the rear end thereof mounts a pair of clevis type connectors 98 which receive the rear end of the servomotors for pivotal movement. A pair of hydraulic lines 100 are connected into the opposite ends of each of the servomotor cylinders in the usual manner for the purpose of delivering hydraulic fluid to one end while taking it from the other. By pumping hydraulic fluid into the front ends of the servomotor cylinders, it is obvious that the piston rods thereof will be actuated into extended position thus elevating the entire frame along with the hopper and associated equipment supported thereon into the inclined position of FIG. 3, all while the three frame sections F, M and R remain folded. The rear jacks 34, and preferably the front one as well, must all be extended while the frame is being unfolded.

Figure 5:
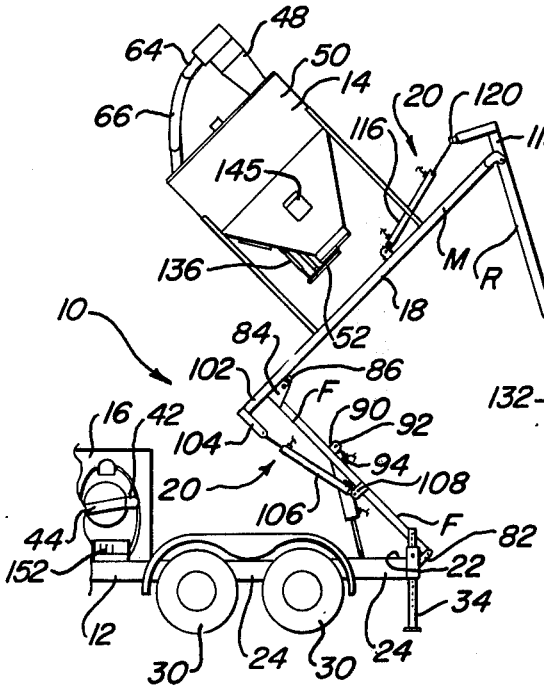
FIG. 5 is a side elevation similar to FIGS. 3 and 4 and to the same scale showing the rear section partially unfolded preparatory to lowering the frame onto the ground, portions of the front end of the trailer and equipment mounted thereon having been broken away to conserve space.

Once the fully folded frame is raised to approximately a 45° angle, further actuation of servomotors 94 is suspended for the time being while the midsection M is unfolded in the manner shown in FIG. 4 to which detailed reference will now be made along with FIGS. 1, 2 and 7. The front end of the midsection M of the frame projects forwardly beyond its point of hinged attachment to the front frame section and this overhanging portion 102 has downturned ends 104 which cooperate to define doglegs that pivotally receive the rod ends of a second pair of hydraulic servomotors 106. The cylinders of these servomotors are pivotally connected to the underside of the front frame section F by suitable clevis type connectors 108. With the frame folded as shown in FIGS. 2 and 7, the servomotors 106 are extended and the doglegged extensions of the midsection M are cradled within the channel of a crossframe element 110 of the trailer bed as seen in FIG. 7. Once lifted into the 45° attitude by means of servomotors 94, however, servomotors 106 can be actuated to retract the piston rods and raise the midsection of the frame along with rear frame section R cradled therebeneath into the right angular relation shown in FIG. 4. As this takes place, the hopper and associated structure will tilt forwardly from a 45° rearward tilt into a 45° forward tilt while opening gap 88 so that the rear frame section R can be unfolded. Actuation of servomotors 106 is simultaneous but completely independent of servomotors 94. Hydraulic fluid is, once again, fed into one end and withdrawn from the opposite end of the servomotors by means of hydraulic lines 112 and 114 shown in FIG. 7. The overhanging doglegged extension of the midsection produces a mechanical advantage which is of considerable importance as it significantly reduces the power required to perform this particular step in the unfolding and folding sequences. Having unfolded the mid and rear frame sections as a unit, the next step is the unfolding of the rear frame section for a description of which reference will be made to FIGS. 5 and 6 along with FIGS. 1, 2 and 7.

Figure 4:
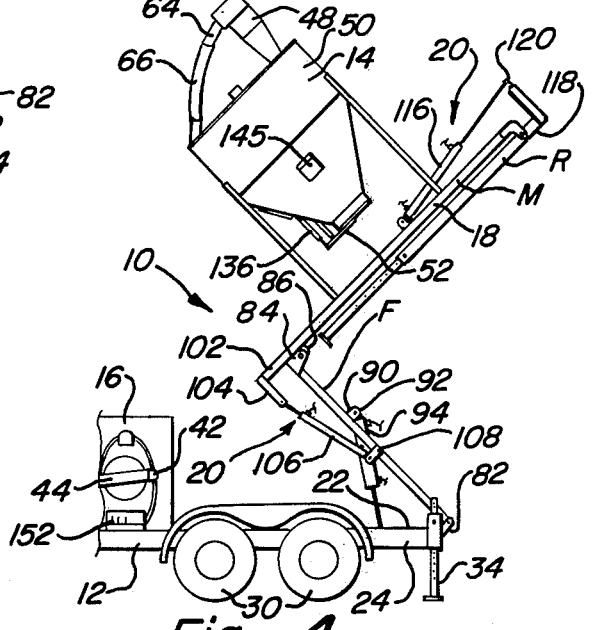
FIG. 4 is a side elevation similar to FIG. 3 and to the same scale showing the midsection and rear section of the frame lifted as a unit into right angular position relative to the front section thereby opening a gap of sufficient size to permit the rear section to unfold.

The load imposed by rear frame section R as it moves from the folded position of FIG. 4 into the fully unfolded position of FIG. 1 is, of course, considerably less than that to which servomotors 94 and 106 are subjected, therefore, a single servomotor 116 is all that is required. In the particular form illustrated, it is centered between the sides of the midsection of the frame (FIG. 6) and has its rod end pivotally attached to a dogleg extension 118 of the rear frame section by means of clevis type connector 120. the front end of the cylinder of servomotor 116 is similarly pivotally attached to crossframe member 122 of the midsection of the frame. Once again, the doglegged extension 118 of the rear frame section beyond its point of hinged attachment 124 with the midsection provides a useful mechanical advantage even though less needed than the one between the front and midsections due to the lesser loads involved. Pivotal connection 124 is accomplished by means of downturned ears 126 on the rear end of the midsection much in the same manner as the hinged connection between the front and midsections thus providing an offset axis of pivotal movement that permits the hinged sections to lie flush one against the other as shown in FIG. 7. Hydraulic lines 128 and 130 connected into opposite ends of the cylinder of servomotor 116 function in the usual manner to extend and retract the piston rod thereof. Actuation of servomotor 116 is independent of the other servomotors and is terminated once the rear frame section reaches the fully unfolded position of FIG. 1.

The final step in the unfolding sequence is, of course, to reactuate servomotors 94 to tilt the entire frame rearwardly until the rear frame section R rests on the ground as shown in FIG. 1. This rear frame section has telescopically adjustable legs 132 which can be locked in adjusted position to accommodate uneven ground. Once the frame is fully unfolded and rests on the ground, it cooperates with the trailer and rear jack to produce a free-standing archway 134 through which a truck can drive and receive the contents of the hopper overhead.

Still another hydraulic servomotor 136 actuates the door 52 that covers the outlet 138 of the hopper. Hydraulic lines 140 and 142 connect into opposite ends of the cylinder and function in the usual manner to close or open the door depending upon the direction of fluid flow therethrough. The door is hingedly attached to a bracket 144 for pivotal movement about a transverse axis intermediate its ends. In order to prevent overfilling of the hopper, a timer controlled solenoid valve (not shown) housed within control box 145 on the side of the hopper automatically actuates to open the hopper door at ten minute intervals or thereabouts.

In some units, middling compartment 68 opens directly into the main hopper compartment 76 where the heaviest particles are deposited in which event both the middlings and heavy particulate matter are discharged simultaneously from the hopper whenever the trap door 52 opens. If, perchance, one wishes to separate the middlings in compartment 68 of the hopper from the heavier particles, then it becomes necessary to close off the latter compartment from the main compartment 76 as shown in FIG. 7. Access to the middlings compartment is then had through door 146 which covers discharge opening 148 therein. A conventional latch 150 holds door 146 closed.

Control of the several servomotors 94, 106, 116 and 136 is accomplished in the usual way by means of conventional mannually actuated control valves 152F, 152M and 152R that control the movements of the front, mid and rear frame sections, respectively. These valves are mounted on the trailer bed where they are readily accessible to an operator standing alongside thereof.

What is claimed is:

1. In combination: a wheel-supported bedframe having a front end and a rear end; a front frame section hingedly attached to the rear end of the bedframe for movement about a first transverse axis between a fully folded position resting atop thereof and a fully unfolded position in upstanding relation atop thereof; a midsection hingedly attached to the front end of the front frame section in offset relation to the latter so as to leave a gap therebetween when folded sized to receive a third frame section, said midsection being mounted for movement about a second axis paralleling the first axis between a fully folded position in spaced substantially parallel relation atop the front frame section and a fully unfolded position in right angular relation to the latter; a rear frame section hingedly attached to the rear end of the midsection for movement about a third axis paralleling the other two between an fully folded position tucked up flush against the underside of said midsection and a fully unfolded position resting on the ground, said front, mid and rear frame sections cooperating with one another in fully unfolded position and with the bedframe to define a free-standing archway; first hydraulic servo-motor means connected between the bed frame and front frame section operative upon actuation to fold and unfold same; second hydraulic servomotor means connected between the front frame section and the midsection independently operable upon actuation to fold and unfold said midsection relative to said front frame section irrespective of the position of the latter; and, third hydraulic servomotor means connected between the rear frame section and the midsection independently operative upon actuation to fold and unfold said rear frame section relative to said midsection when the latter is in unfolded position.

2. The combination of claim 1 wherein the wheeled bedframe has wheels mounted intermediate the ends thereof; and, in which jacks are provided on the rear end of the bedframe operative in extended position to cooperate with the wheels to produce a stable platform effective to support the foldable frame while being folded and unfolded.

3. The combination of claim 1 wherein the second axis is located intermediate the ends of the midsection so as to produce a forwardly-overhanging portion; and, in which the second hydraulic servomotor means is connected to said forwardly-overhanging portion adjacent the front end thereof.

4. The combination of claim 1 wherein the third axis is located intermediate the ends of the rear section so as to produce a rearwardly-overhanging portion; and, which the third hydraulic servomotor means is connected to said rearwardly-overhanging portion adjacent the rear end thereof.

5. The combination as set forth in claim 1 wherein a hopper having a trap door in the bottom thereof is mounted atop the midsection; and, in which said midsection comprises an open skeletal framework so designed as to not impede the gravity flow of the hoppers contents therethrough.

6. The combination as set forth in claim 1 wherein the rear frame section includes telescopically adjustable upright leg portions on both sides thereof.

7. The combination as set forth in claim 2 wherein the center of mass of the foldable frame lies to the rear of the wheels; and, in which counterbalancing means are provided on the front of the bedframe forwardly of the wheels.

8. The combination as set forth in claim 3 wherein the forwardly-overhanging poriton has a downturned doglegged configuration; and, in which the second hydraulic servomotor means is connected to said overhanging portion for pivotal movement about a transverse axis located beneath the second axis when said midsection is in fully folded position.

9. The combination as set forth in claim 4 wherein the rearwardly-overhanging portion has an upturned doglegged configuration; and, in which the third hydraulic servomotor means is connected to said overhanging portion for pivotal movement about a transverse axis located above the third axis when said rear section is in fully folded position.

* * * * *